US011284752B1

(12) United States Patent
Haberman

(10) Patent No.: US 11,284,752 B1
(45) Date of Patent: Mar. 29, 2022

(54) TOWEL MOISTENING ASSEMBLY

(71) Applicant: Jeffrey Haberman, Renton, WA (US)

(72) Inventor: Jeffrey Haberman, Renton, WA (US)

( * ) Notice: Subject to any disclaimer, the term of this patent is extended or adjusted under 35 U.S.C. 154(b) by 56 days.

(21) Appl. No.: 17/032,599

(22) Filed: Sep. 25, 2020

(51) Int. Cl.
*A47K 10/32* (2006.01)

(52) U.S. Cl.
CPC ..... *A47K 10/32* (2013.01); *A47K 2010/3266* (2013.01)

(58) Field of Classification Search
USPC ..... 221/33–63
See application file for complete search history.

(56) References Cited

U.S. PATENT DOCUMENTS 4,694,973 A * 9/1987 Rose ..... A47K 10/32 221/46
D372,615 S 8/1996 Owens
6,158,614 A 12/2000 Haines
6,189,730 B1 2/2001 McClymonds
6,592,001 B2 7/2003 Lewis
6,899,250 B2 5/2005 FitzSimons
7,743,947 B2 6/2010 Flasch
2009/0302049 A1* 12/2009 Cornell ..... A47K 10/3818 221/34
2015/0173573 A1* 6/2015 Dunn ..... B65D 43/16 206/581

FOREIGN PATENT DOCUMENTS

WO WO200740271146 4/2004

* cited by examiner

*Primary Examiner* — Gene O Crawford
*Assistant Examiner* — Ayodeji T Ojofeitimi

(57) ABSTRACT

A towel moistening assembly includes a first container for containing a plurality of towels. A second container is provided for containing a fluid bodily treatment. The second container has an entry way that is aligned with the first container to facilitate the towels to be drawn upwardly therethrough. A lid is removably attachable to the second container for closing the second container. The lid has an exit extending therethrough and the towels can be drawn outwardly therethrough when the towels are drawn outwardly through the entry way in the second container. In this way the towel can be moistened with the fluid bodily treatment to be employed by a user.

13 Claims, 6 Drawing Sheets

TOWEL MOISTENING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to moistening devices and more particularly pertains to a new moistening device for dispensing towels that are pre-moistened with a fluid bodily treatment.

(2) Description of Related Art Including Information Disclosed Under 37 CFR 1.97 and 1.98

The prior art relates to moistening devices including a variety of cylindrical containers that have a dispensing port for drawing moistened towels outwardly therefrom. In each instance the prior art discloses either a single container or a pair of containers that are fluidly discrete from each other.

BRIEF SUMMARY OF THE INVENTION

An embodiment of the disclosure meets the needs presented above by generally comprising a first container for containing a plurality of towels. A second container is provided for containing a fluid bodily treatment. The second container has an entry way that is aligned with the first container to facilitate the towels to be drawn upwardly therethrough. A lid is removably attachable to the second container for closing the second container. The lid has an exit extending therethrough and the towels can be drawn outwardly therethrough when the towels are drawn outwardly through the entry way in the second container. In this way the towel can be moistened with the fluid bodily treatment to be employed by a user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
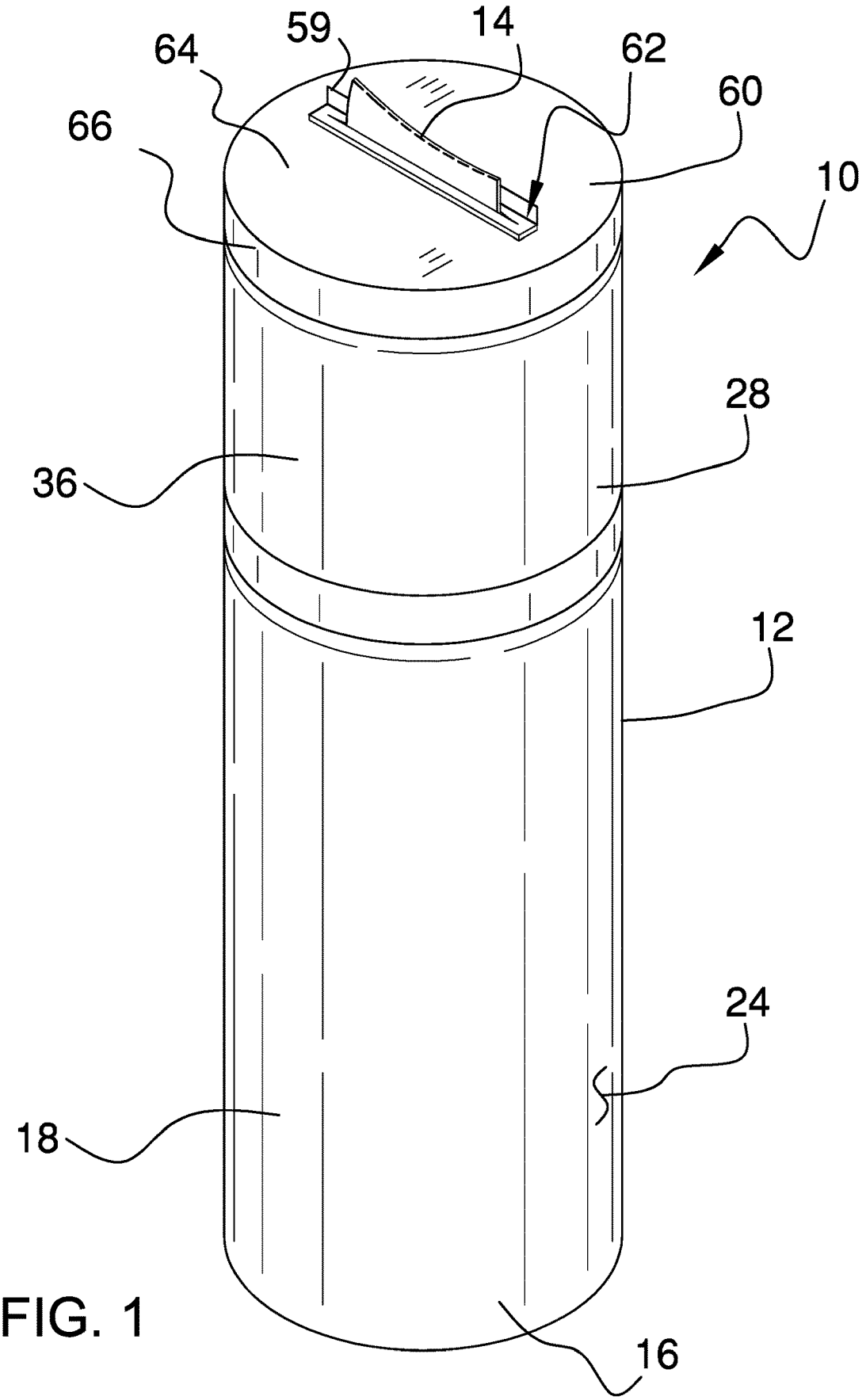
FIG. 1 is a perspective view of a towel moistening assembly according to an embodiment of the disclosure.
Figure 2:
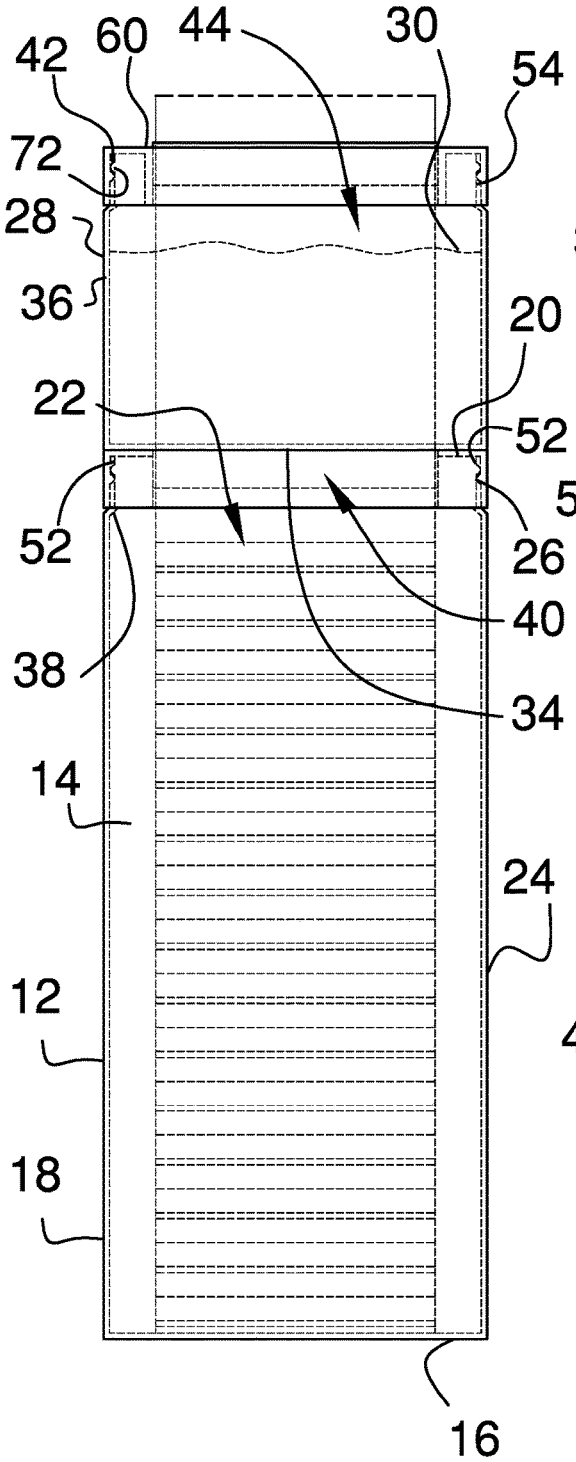
FIG. 2 is a front phantom view of an embodiment of the disclosure.
Figure 3:
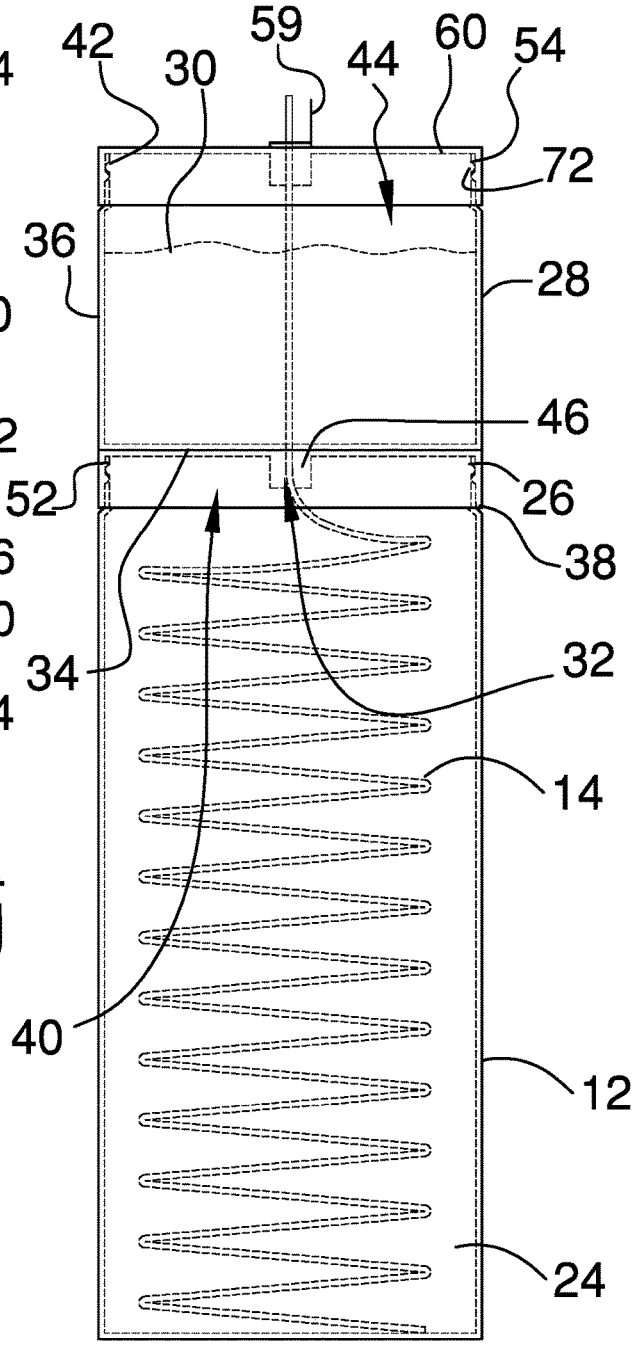
FIG. 3 is a right side phantom view of an embodiment of the disclosure.
Figure 4:
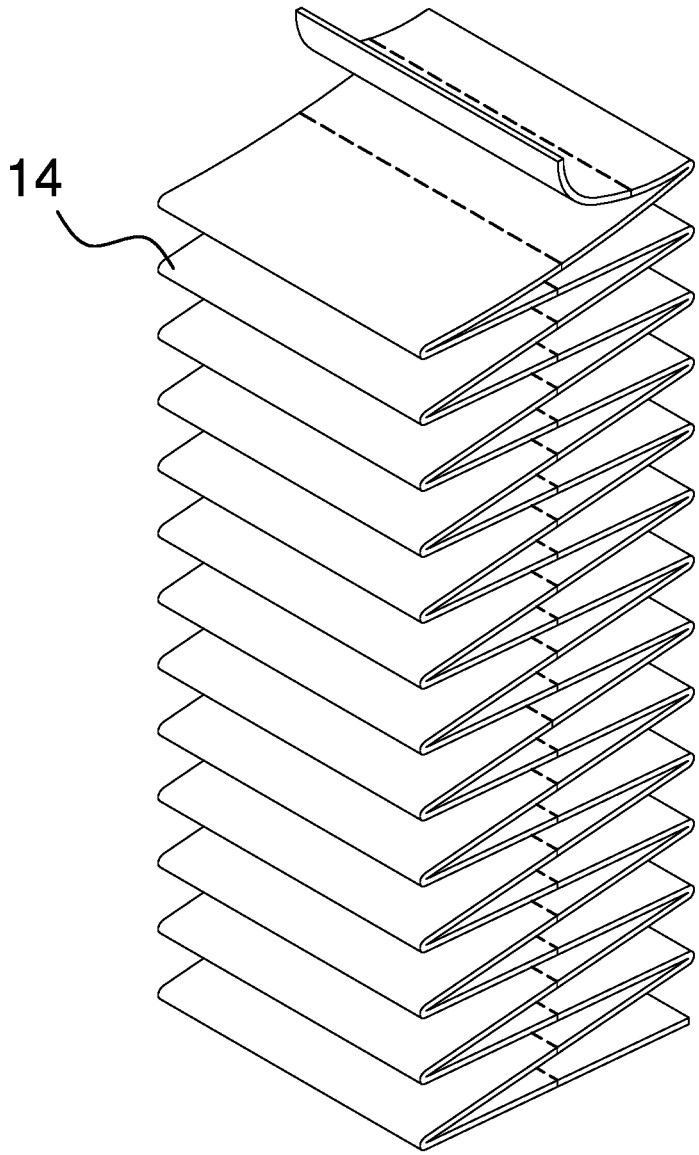
FIG. 4 is a perspective view of a plurality of towels of an embodiment of the disclosure.
Figure 5:
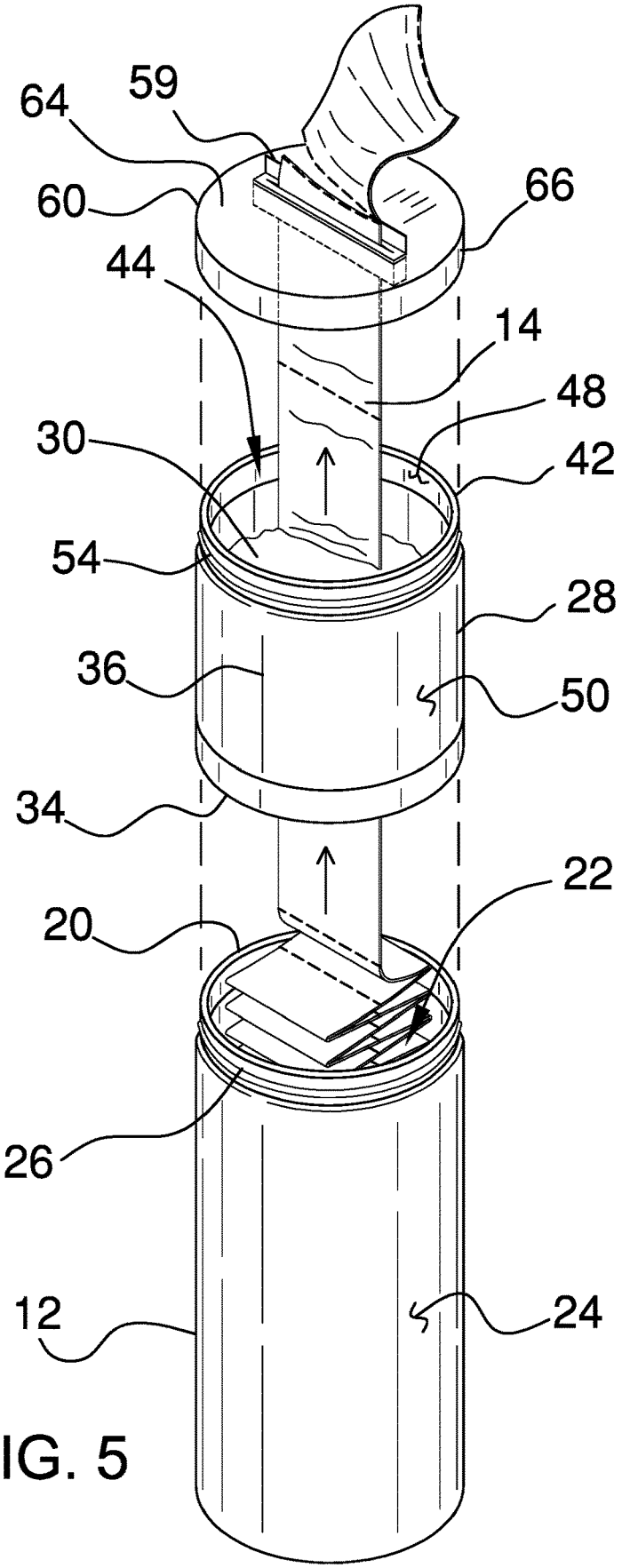
FIG. 5 is an exploded perspective view of an embodiment of the disclosure.
Figure 6:
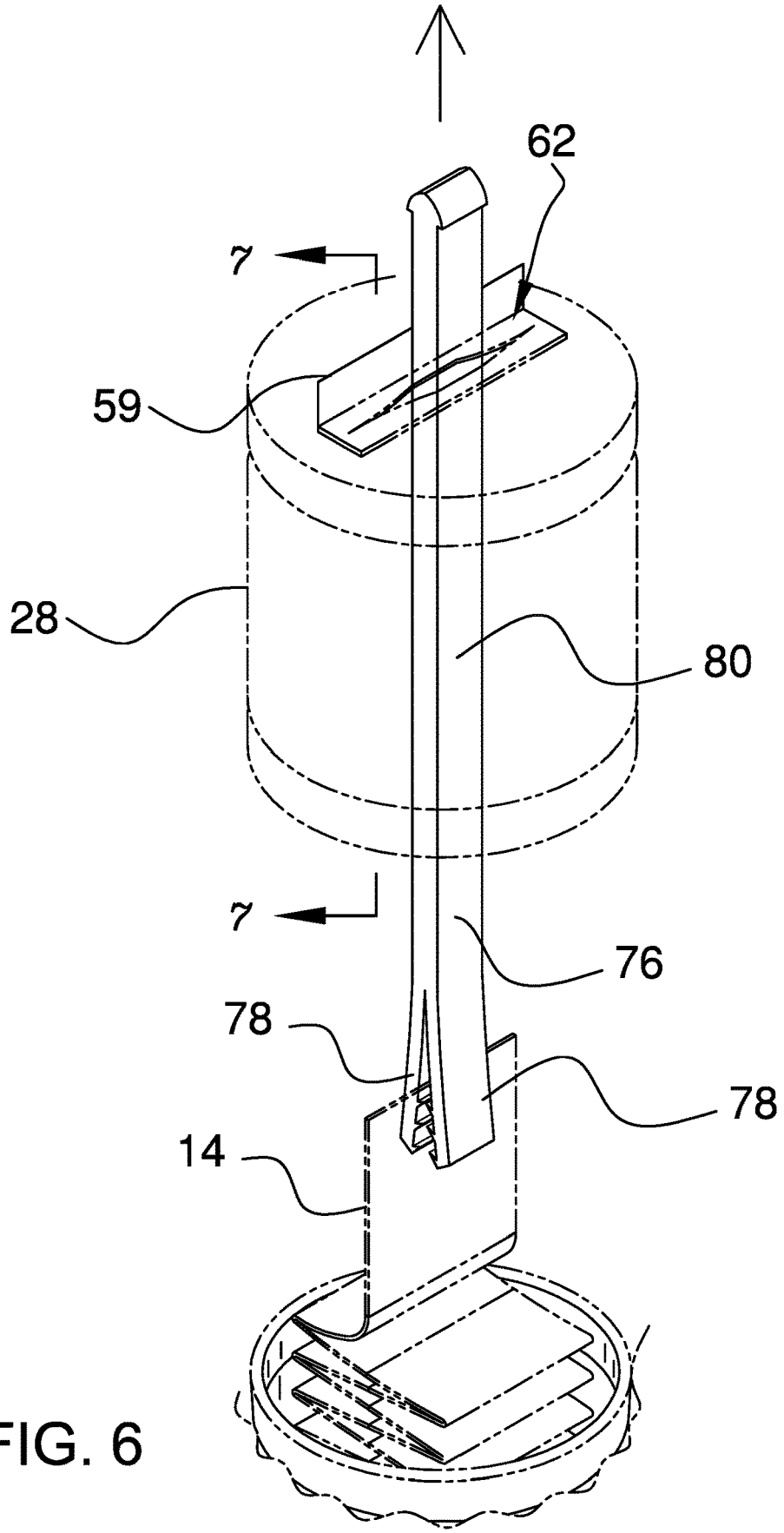
FIG. 6 is a perspective in-use view of an embodiment of the disclosure.
Figure 7:
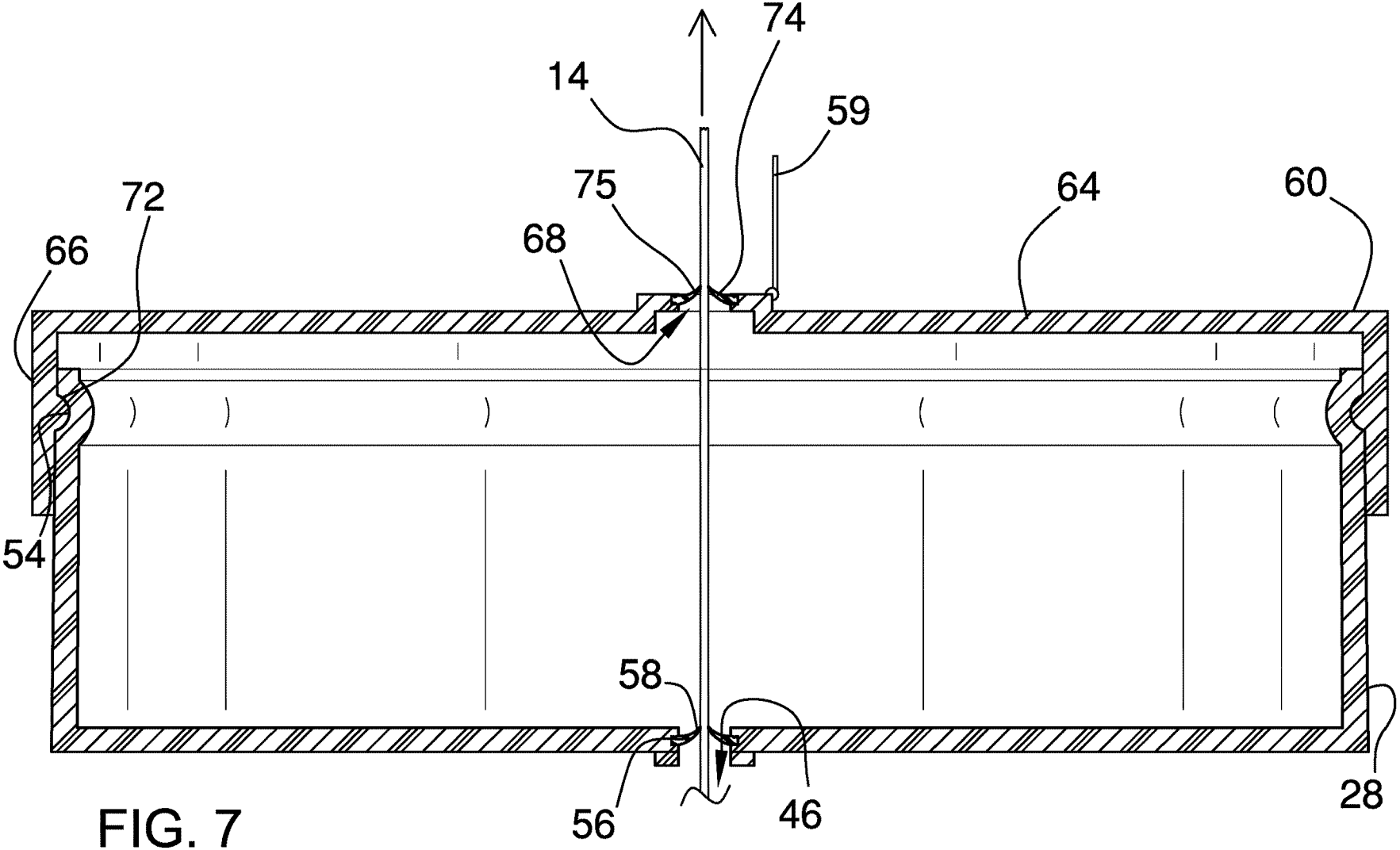
FIG. 7 is a cross sectional view taken along line 7-7 of FIG. 1 of an embodiment of the disclosure.

With reference now to the drawings, and in particular to FIGS. 1 through 7 thereof, a new moistening device embodying the principles and concepts of an embodiment of the disclosure and generally designated by the reference numeral 10 will be described.

As best illustrated in FIGS. 1 through 7, the towel moistening assembly 10 generally comprises a first container 12 that contains a plurality of towels 14. The plurality of towels 14 may be a chain of cleaning wipes or other type of towels that are removably attached together in a chain. Additionally, the plurality of towels 14 may include a leading towel which will henceforth be referred to as the towel or a towel. The first container 12 has a bottom wall 16 and an outer wall 18 extending upwardly therefrom, and the outer wall 18 has a distal edge 20 with respect to the bottom wall 16 to define an opening 22 into the first container 12. The outer wall 18 has an outer surface 24 and the outer surface 24 has a plurality of first engagements 26 each being integrated therein. Each of the first engagements 26 extends along a line is oriented parallel to the distal edge 20.

A second container 28 is provided and the second container 28 is comprised of a fluid impermeable material to contain a fluid bodily treatment 30. The fluid bodily treatment 30 may be skin lotion, sun screen, tanning lotion or any other type of fluid bodily treatment that is commonly applied to human skin. The second container 28 has an entry way 32 that is aligned with the first container 12 thereby facilitating the towels 14 to be drawn upwardly therethrough. The second container 28 has a lower wall 34 and an outside wall 36 extending upwardly therefrom, and the outside wall 36 extends downwardly beyond the lower wall 34 to define a lower edge 38 of the outside wall 36 defining a first opening 40 into the second container 28.

The outside wall 36 has an upper edge 42 defining a second opening 44 into the second container 28. The lower wall 34 has a first slot 46 extending therethrough to define the entry way 32 into the second container 28. The outside wall 36 has an inside surface 48 and an outside surface 50, and a plurality of first attachments 52 is each coupled to the inside surface 48. Each of the first attachments 52 is positioned adjacent to the lower edge 38 and each of the first attachments 52 engages a respective one of the first engagements 26 on the outer surface 24 of the outer wall 18 of the first container 12.

The second container 28 is rotatable into a locking position for locking each of the first attachments 52 into the respective first engagement 26 thereby retaining the second container 28 on the first container 12. In this way the towels 14 can be drawn upwardly through the first slot 46 for infusing the towels 14 with the fluid bodily treatment 30 in the second container 28. The second container 28 is rotatable into an unlocking position for unlocking each of the first attachments 52 from the respective first engagement 26 thereby facilitating the second container 28 to be removed from the first container 12.

The outside surface 50 of the outside wall 36 has a plurality of second engagements 54 thereon and each of the second engagements 54 is positioned adjacent to the upper edge 42 of the outer wall 18. Each of the second engagements 54 is oriented to extend along a line oriented parallel to the upper edge 42. Each of the first engagements 26 and each of the second engagements 54 may comprise a channel that extends into the outer wall 18.

A first membrane 56 is coupled to the lower wall 34 of the second container 28 and the first membrane 56 covers the first slot 46 to inhibit the fluid bodily treatment 30 from passing through the first slot 46. The first membrane 56 has a cut 58 extending therethrough to facilitate the towels 14 to be drawn therethrough and into the second container 28. The first membrane 56 may be comprised of rubber or other type of flexible and fluid impermeable material.

A lid 60 is provided and the lid 60 is removably attachable to the second container 28 for closing the second container 28. The lid 60 has an exit 62 extending therethrough and the towels 14 can be drawn outwardly therethrough when the towels 14 are drawn outwardly through the entry way 32 in the second container 28. In this way the towels 14 are moistened with the fluid bodily treatment 30 to be employed by a user. Thus, each of the towels 14 can be wiped on a user's skin to apply the fluid bodily treatment 30 to the user's skin.

The lid 60 has a top wall 64 and a perimeter wall 66 extending downwardly therefrom, and the top wall 64 has a second slot 68 extending therethrough to define the exit 62 in the lid 60. The perimeter wall 66 has an inside surface 70 a plurality of second attachments 72 is each positioned on the inside surface 48. Each of the second attachments 72 engages a respective one of the second engagements 54 on the outside surface 50 of the outside wall 36 of the second container 28. A cover 59 is hingedly coupled to the top wall 64 of the lid 60 and the cover 59 is aligned with the second slot 68. The cover 59 is positionable in a closed position having the cover 59 covering the second slot 68 for protecting the towels 14 from contamination. The cover 59 is positionable in an open position such that the second slot 68 is exposed to facilitate the towels 14 to be drawn outwardly through the second slot 68.

The lid 60 is rotatable into a locking position having each of the second attachments 72 locking into the respective second engagement 54. In this way the lid 60 is retained on the second container 28 thereby aligning the second slot 68 with the first slot 46. Thus, the towels 14 can be drawn outwardly through the second slot 68. The lid 60 is rotatable into an unlocking position having each of the second attachments 72 unlocking from the respective second engagement 54 thereby facilitating the lid 60 to be removed from the second container 28. Each of the first attachments 52 and each of the second attachments 72 may comprise tabs that can slidably engage the channels of which the first engagements 26 and second engagements 54 may be comprised.

A second membrane 74 provided and the second membrane 74 is coupled to the lid 60. The second membrane 74 covers the second slot 68 and the second membrane 74 has a cut 75. In this way the towels 14 can be drawn outwardly through the cut 75 in the second membrane 74. The second membrane 74 may be comprised of rubber or other similar type of flexible and fluid impermeable material. As is most clearly shown in FIG. 6, a tool 76 may be provided that has a pair of jaws 78 that are biased toward each other and an elongated handle 80. The tool 76 may be extended through the first membrane 56 and the second membrane 74 to facilitate the jaws 78 to engage a towel 14. In this way the tool 76 can be pulled upwardly to draw the towel 14 through the first membrane 56 and second membrane 74.

In use, the plurality of towels 14 is positioned in the first container 12 and a towel 14 is extended through the first membrane 56. The second container 28 is filled with the fluid bodily treatment 30, the towel 14 is extended through the second membrane 74 and the lid 60 is attached to the second container 28. Thus, the towels 14 are moistened with the fluid bodily treatment 30 as the towels 14 are drawn upwardly through the second container 28. In this way the towels 14 can be wiped on the user's skin to apply the fluid bodily treatment 30 to the user's skin.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A towel moistening assembly for storing towels and a fluid bodily treatment thereby facilitating the towels to be covered in the fluid bodily treatment when the towels are removed, said assembly comprising:

a first container being configured to containing a plurality of towels;

a second container being comprised of a fluid impermeable material wherein said second container is configured to contain a fluid bodily treatment, said second container having an entry way being aligned with said first container wherein said entry way is configured to have the towels drawn upwardly therethrough; and a lid being removably attachable to said second container for closing said second container, said lid having an exit extending therethrough wherein said exit is configured to have the towels drawn outwardly therethrough when the towels are drawn outwardly through said entry way in said second container thereby facilitating the towel moistened with the fluid bodily treatment to be employed by a user.

2. The assembly according to claim 1, wherein said first container has a bottom wall and an outer wall extending upwardly therefrom, said outer wall having a distal edge with respect to said bottom wall to define an opening into said first container, said outer wall having an outer surface, said outer surface having a plurality of first engagements each being integrated therein, each of said first engagements extending along a line being oriented parallel to said distal edge.

3. The assembly according to claim 1, wherein said second container has a lower wall and an outside wall extending upwardly therefrom, said outside wall extending downwardly beyond said lower wall to define a lower edge of said outside wall defining a first opening into said second container, said outside wall having an upper edge defining a second opening into said second container.

4. The assembly according to claim 3, wherein said lower wall has a first slot extending therethrough to define said entry way into said second container.

5. The assembly according to claim 4, wherein:

said first container has a plurality of first engagements each being positioned on an outer surface of an outer wall of said first container; and said outside wall has an inside surface and an outside surface, said inside surface having a plurality of first attachments each being coupled thereto, each of said first attachments being positioned adjacent to said lower edge, each of said first attachments engaging a respective one of said first engagements on said outer surface of said outer wall of said first container.

6. The assembly according to claim 4, further comprising a first membrane being coupled to said lower wall of said second container, said first membrane covering said first slot wherein said first membrane is configured to inhibit the fluid bodily treatment from passing through said first slot, said first membrane having a cut extending therethrough wherein said cut is configured to facilitate the towels to be drawn therethrough and into said second container.

7. The assembly according to claim 5, wherein said second container is rotatable into a locking position for locking each of said first attachments into said respective first engagement thereby retaining said second container on said first container wherein said first slot is configured to have the towels drawn upwardly therethrough for infusing the towels with the fluid bodily treatment in said second container, said second container being rotatable into an unlocking position for unlocking each of said first attachments from said respective first engagement thereby facilitating said second container to be removed from said first container.

8. The assembly according to claim 5, wherein said outside surface of said outside wall has a plurality of second engagements thereon, each of said second engagements being positioned adjacent to said upper edge of said outer wall, each of said second engagements being oriented to extend along a line oriented parallel to said upper edge.

9. The assembly according to claim 8, wherein said lid has a top wall and a perimeter wall extending downwardly therefrom, said top wall having a second slot extending therethrough to define said exit in said lid.

10. The assembly according to claim 9, wherein said perimeter wall has an inside surface, said inside surface of said perimeter wall having a plurality of second attachments thereon, each of said second attachments engaging a respective one of said second engagements on said outside surface of said outside wall of said second container.

11. The assembly according to claim 9, further comprising:

a first membrane being coupled to said second container; and a second membrane being coupled to said lid, said second membrane covering said second slot, said second membrane having a cut therein wherein said cut is configured to facilitate the towels to be drawn outwardly therefrom.

12. The assembly according to claim 10, wherein said lid is rotatable into a locking position having each of said second attachments locking into said respective second engagement for retaining said lid on said second container thereby aligning said second slot with said first slot wherein said second slot is configured to have the towels drawn outwardly therefrom, said lid being rotatable into an unlocking position having each of said second attachments unlocking from said respective second engagement thereby facilitating said lid to be removed from said second container.

13. A towel moistening assembly for storing towels and a fluid bodily treatment thereby facilitating the towels to be covered in the fluid bodily treatment when the towels are removed, said assembly comprising:

a first container being configured to containing a plurality of towels, said first container having a bottom wall and an outer wall extending upwardly therefrom, said outer wall having a distal edge with respect to said bottom wall to define an opening into said first container, said outer wall having an outer surface, said outer surface having a plurality of first engagements each being integrated therein, each of said first engagements extending along a line being oriented parallel to said distal edge;

a second container being comprised of a fluid impermeable material wherein said second container is configured to contain a fluid bodily treatment, said second container having an entry way being aligned with said first container wherein said entry way is configured to have the towels drawing upwardly therethrough, said second container having a lower wall and an outside wall extending upwardly therefrom, said outside wall extending downwardly beyond said lower wall to define a lower edge of said outside wall defining a first opening into said second container, said outside wall having an upper edge defining a second opening into said second container, said lower wall having a first slot extending therethrough to define said entry way into said second container, said outside wall having an inside surface and an outside surface, said inside surface having a plurality of first attachments each being coupled thereto, each of said first attachments being positioned adjacent to said lower edge, each of said first attachments engaging a respective one of said first engagements on said outer surface of said outer wall of said first container, said second container being rotatable into a locking position for locking each of said first attachments into said respective first engagement thereby retaining said second container on said first container wherein said first slot is configured to have the towels drawn upwardly therethrough for infusing the towels with the fluid bodily treatment in said second container, said second container being rotatable into an unlocking position for unlocking each of said first attachments from said respective first engagement thereby facilitating said second container to be removed from said first container, said outside surface of said outside wall having a plurality of second engagements thereon, each of said second engagements being positioned adjacent to said upper edge of said outer wall, each of said second engagements being oriented to extend along a line oriented parallel to said upper edge;

a first membrane being coupled to said lower wall of said second container, said first membrane covering said first slot wherein said first membrane is configured to inhibit the fluid bodily treatment from passing through said first slot, said first membrane having a cut extending therethrough wherein said cut is configured to facilitate the towels to be drawn therethrough and into said second container;

a lid being removably attachable to said second container for closing said second container, said lid having an exit extending therethrough wherein said exit is configured to have the towels drawn outwardly therethrough when the towels are drawn outwardly through said entry way in said second container thereby facilitating the towel moistened with the fluid bodily treatment to be employed by a user, said lid having a top wall and a perimeter wall extending downwardly therefrom, said top wall having a second slot extending therethrough to define said exit in said lid, said perimeter wall having an inside surface, said inside surface of said perimeter wall having a plurality of second attachments thereon, each of said second attachments engaging a respective one of said second engagements on said outside surface of said outside wall of said second container, said lid being rotatable into a locking position having each of said second attachments locking into said respective second engagement for retaining said lid on said second container thereby aligning said second slot with said first slot wherein said second slot is configured to have the towels drawn outwardly therefrom, said lid being rotatable into an unlocking position having each of said second attachments unlocking from said respective second engagement thereby facilitating said lid to be removed from said second container; and a second membrane being coupled to said lid, said second membrane covering said second slot, said second membrane having a cut therein wherein said cut is configured to facilitate the towels to be drawn outwardly therefrom.

* * * * *